US007391394B2

(12) United States Patent
Hu

(10) Patent No.: US 7,391,394 B2
(45) Date of Patent: Jun. 24, 2008

(54) ELECTROLUMINESCENT DISPLAY

(75) Inventor: Shuo-Hsiu Hu, Tainan (TW)

(73) Assignee: Au Optronics Corporation, Hsinchu (TW)

( * ) Notice: Subject to any disclaimer, the term of this patent is extended or adjusted under 35 U.S.C. 154(b) by 720 days.

(21) Appl. No.: 10/850,729

(22) Filed: May 21, 2004

(65) Prior Publication Data

US 2005/0258774 A1 Nov. 24, 2005

(51) Int. Cl.
*G09G 3/30* (2006.01)

(52) U.S. Cl. ..... 345/76; 345/77; 345/82; 315/169

(58) Field of Classification Search ..... 345/76–77, 345/82; 315/169
See application file for complete search history.

(56) References Cited

U.S. PATENT DOCUMENTS 6,509,692 B2 1/2003 Komiya ..... 315/169.3
6,535,185 B2 * 3/2003 Kim et al. ..... 345/76
6,867,551 B2 * 3/2005 Okuda ..... 315/169.3

* cited by examiner

*Primary Examiner*—Richard Hjerpe
*Assistant Examiner*—Leonid Shapiro
(74) *Attorney, Agent, or Firm*—David I. Roche; Baker & McKenzie LLP

(57) ABSTRACT

In an electroluminescent display, a pixel driving circuit is coupled between a ground potential terminal and a power voltage terminal of a power source to drive the operation of a light-emitting device. Upon receiving addressing and image data signals from a scan line and a data line, the pixel driving circuit operates to deliver an electric current to the light-emitting device according to the image data signal.

16 Claims, 4 Drawing Sheets

ELECTROLUMINESCENT DISPLAY

BACKGROUND OF THE INVENTION

1. Field of the Invention

This invention generally relates to electroluminescent display technology, and more particularly to an electroluminescent display that can reduce the power consumed while driving the pixel array.

2. Description of the Related Art

Electroluminescent display technology has recently attracted many researches and developments in the field of emissive displays. Compared to other types of emissive displays such as the plasma display, the electroluminescent display promises advantages such as lower power consumption, reduced size, and high image brightness and sharpness. An electroluminescent display system conventionally includes a mesh of scan and data lines that define an array of pixels in each of which is coupled one electroluminescent or light-emitting device. The light-emitting device particularly can be an organic light-emitting device (OLED), and is usually driven by a driving circuit associated to each pixel.

Conventionally, a basic OLED cell is constructed from a stack of layers made of organic material and sandwiched between two electrode layers, i.e. one anode and one cathode. The organic layers are configured to form functional layers usually including a hole transport layer, an emissive layer, and an electron transport layer. When an adequate voltage is applied between the anode and the cathode, the injected positive and negative charges recombine in the emissive layer to produce light.

FIG. 1A is a schematic view of a conventional pixel driving circuit implemented in an organic electroluminescent display known in the art. The pixel driving circuit 110 includes two transistors 112, 114, a storage capacitor 116, and an organic light-emitting diode 118. The transistors 112, 114 can be any types of transistor, such as PMOS thin film transistors or the like. The transistor 112 works as a switch and includes a gate connected to a scan line SCAN, and a source connected to a data line DATA, and a drain connected to the storage capacitor 116. The transistor 114 works as a current driver and includes a source connected to the anode of the organic light-emitting diode 118, while its drain is connected to a positive voltage terminal PV. The storage capacitor 116 is coupled between the gate and the drain of the transistor 114. The cathode of the organic light-emitting diode 118 is connected to a ground potential., In this conventional circuit scheme, the voltage bias applied between the terminal PV and the ground potential usually results in a gate voltage of the driving transistor 114 between about +4.5V and +6.5V to have its operating in the saturation range for delivering an electric current to the organic light-emitting diode 118. This constitutes a relatively high power consumption that requires specific manufacture techniques to construct a reliable driving circuitry.

FIG. 1B illustrates another pixel driving circuit known in the art. This pixel driving circuit is disclosed in U.S. Pat. No. 6,509,692 issued to Komiya, the entire disclosure of which is incorporated herein by reference. The pixel driving circuit shown in FIG. 1B is very similar to that of FIG. 1A, except that the power source includes a positive voltage terminal PV and a negative voltage terminal CV between both of which are coupled the driving transistor 114 and the organic light-emitting diode 118.

This configuration of the power source enables to reduce the operating gate voltage of the driving transistor 114 down to a voltage range between about 3V and 0.5V. As a result, the driving circuitry can be constructed with less expensive CMOS techniques and operate with a lower power consumption.

FIG. 1C is a general diagram of a power generator circuit conventionally implemented to provide the power source of FIG. 1B. Conventionally, two power circuits including two DC/DC converters 130 are required to convert an initial voltage V to positive and the negative voltage potentials PV, CV. As a result, the manufacture cost is usually increased for this type of power source configured with both positive and negative voltage potentials. Further, the conversion efficiency of the DC/DC converter 130 usually is about 80%, in other words undesirable energy dissipation occurs in the power source. In addition, the installation of two DC/DC converters 130 increases the ripple factor, which affects the image quality of the display system. The foregoing and other disadvantages call for improvements of the power source in the pixel driving circuit.

Therefore, there is presently a need for an electroluminescent display, and in particular a pixel driving circuit that can overcome the disadvantages related to the power source.

SUMMARY OF THE INVENTION

The application describes an electroluminescent display that can overcome the disadvantages of the prior art display.

In one embodiment, the electroluminescent display includes a power voltage source having a negative voltage terminal and a ground potential terminal, and a pixel driving circuit coupled between the negative voltage terminal and the ground potential to drive the operation of a light-emitting device in response to addressing and image data signals inputted to the pixel driving circuit.

In one embodiment, the pixel driving circuit includes a current driving circuit coupled with the light-emitting device between the ground potential terminal and the negative voltage terminal, a storage capacitor coupled with the current driving circuit, and a switch circuit coupled with the scan line, the data line and the storage capacitor. The current driving circuit is configured to deliver to the light-emitting device an electric current set according to a charge voltage of the storage capacitor. The storage capacitor is selectively charged by the switch circuit in response to scan and data signals received on the scan and data lines, respectively.

The foregoing is a summary and shall not be construed to limit the scope of the claims. The operations and structures disclosed herein may be implemented in a number of ways, and such changes and modifications may be made without departing from this invention and its broader aspects. Other aspects, inventive features, and advantages of the invention, as defined solely by the claims, are described in the non-limiting detailed description set forth below.

DETAILED DESCRIPTION OF THE EMBODIMENT(S)

The application describes an electroluminescent display, and in particular a pixel driving circuit implemented in the electroluminescent display. The electroluminescent display particularly can be an active matrix organic electroluminescent display. Notwithstanding, the inventive features as described herein are intended to be generally suitable for many instances of electroluminescent display.

Figure 1A:
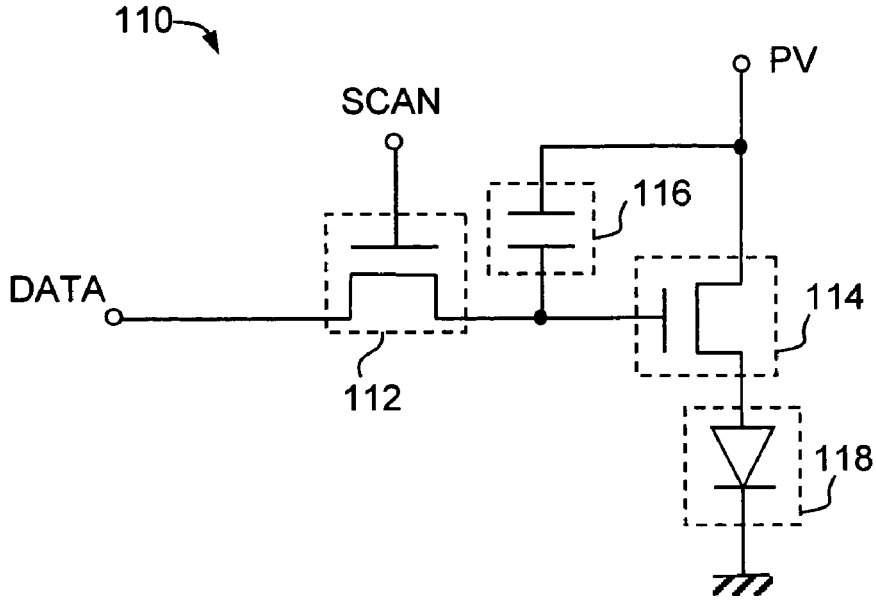
Figure 1A (Prior Art)
FIG. 1A is a schematic diagram of a conventional pixel driving circuit implemented in an electroluminescent display known in the prior art.
Figure 1B:
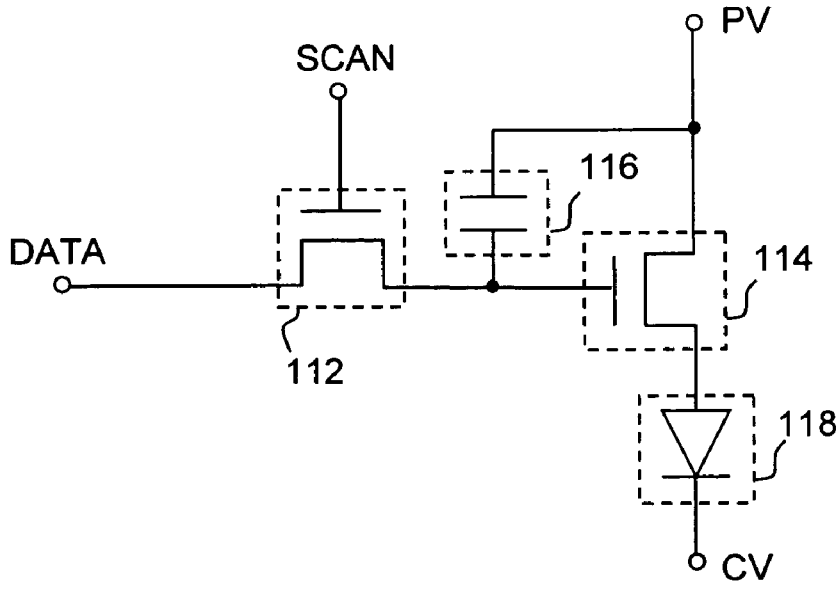
Figure 1B (Prior Art)
FIG. 1B is a schematic diagram of another conventional pixel driving circuit known in the prior art.
Figure 1C:
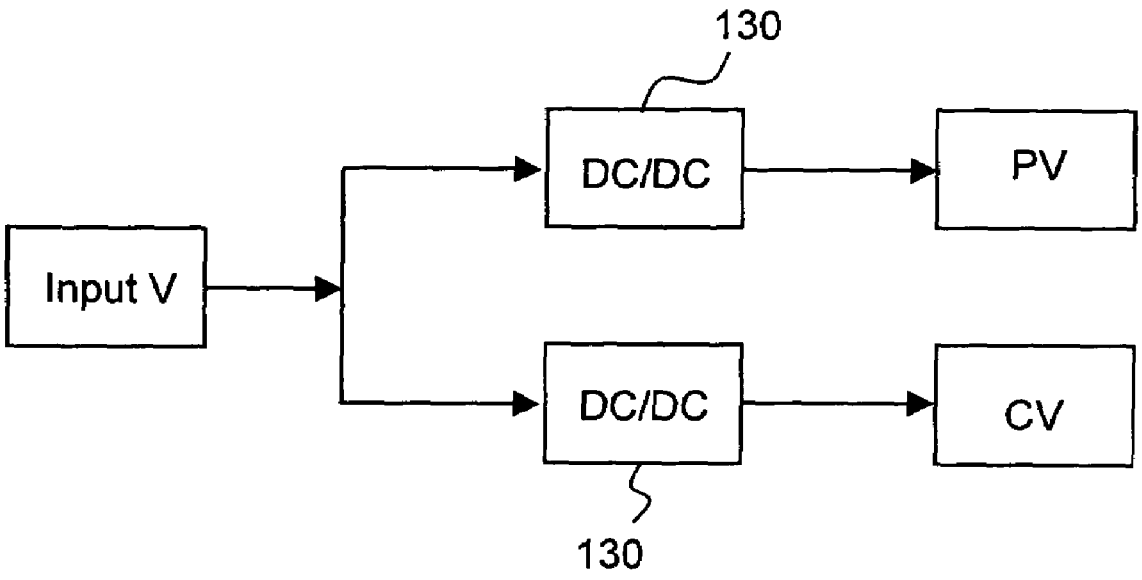
Figure 1C (Prior Art)
FIG. 1C is a schematic diagram of a power generator circuit known in the art.
Figure 2A:
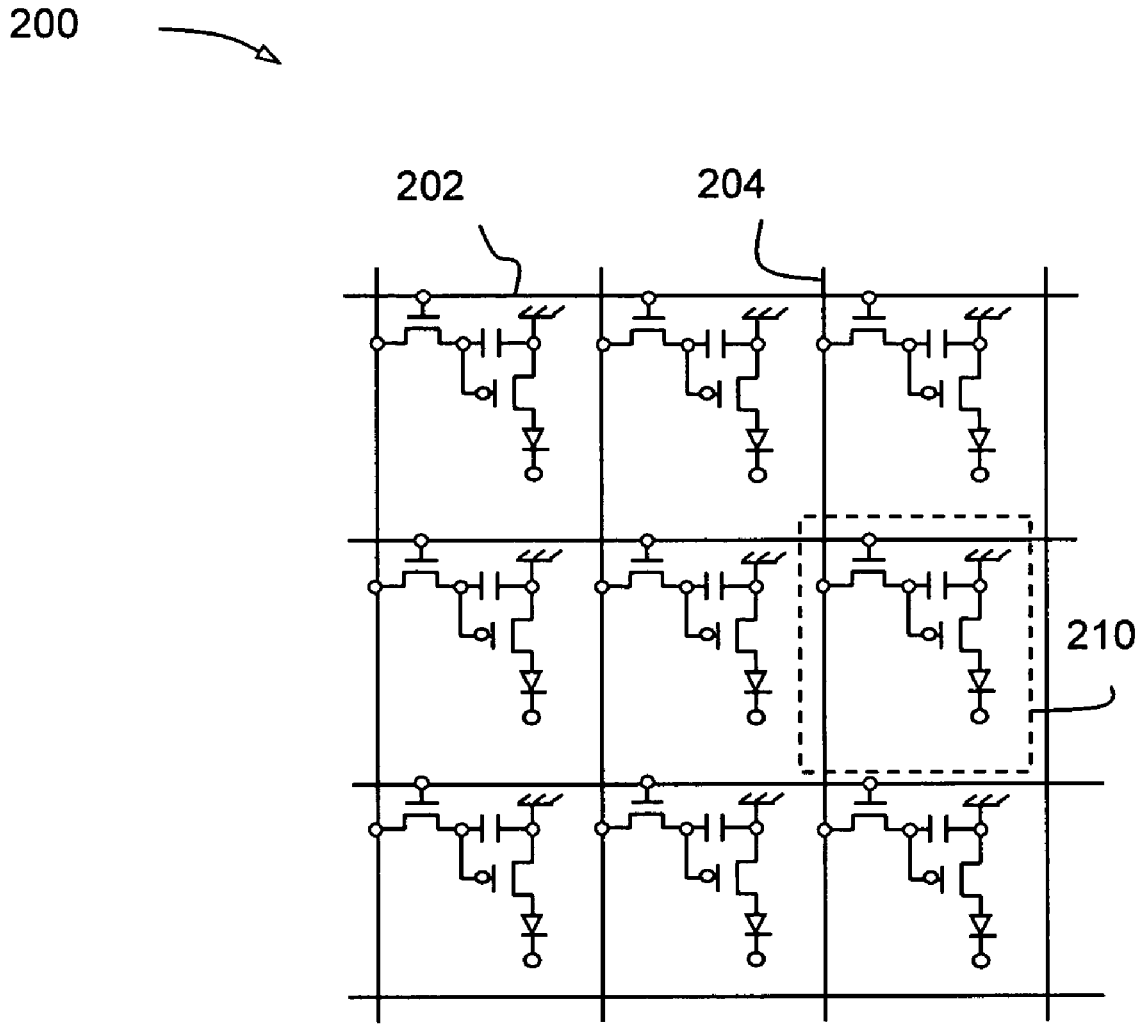
FIG. 2A is a schematic diagram of a pixel array implemented in an electroluminescent display according to an embodiment of the invention.
Figure 2B:
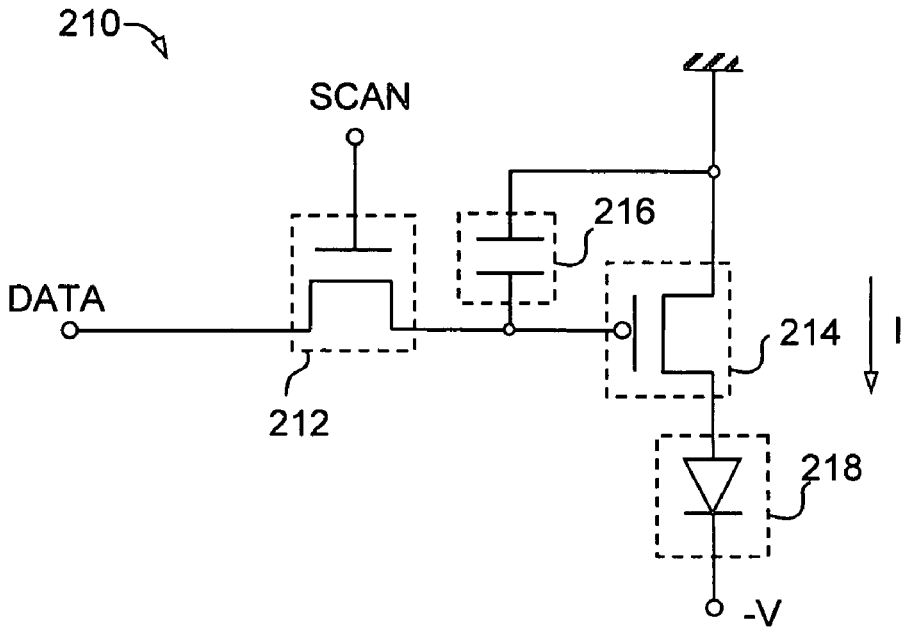
FIG. 2B is a schematic diagram of a pixel driving circuit implemented in an electroluminescent display according to an embodiment of the invention.

FIG. 2A is a general view of a pixel array implemented in an electroluminescent display according to one embodiment of the invention, and FIG. 2B is a schematic diagram of a driving circuit implemented in one pixel 210 as shown in FIG. 2A. The electroluminescent display can be exemplary an active matrix organic electroluminescent display system. The pixel array 200 includes a mesh of scan, data lines 202, 204 that defines an array of pixels 210. The scan lines 202 convey addressing signals delivered to select pixels 210 to be illuminated, while the data lines 204 convey image data signals for controlling the level of illumination of the electroluminescent device in each pixel 210.

In one pixel 210, a driving circuit couples with one scan, data line 202, 204 and an organic light-emitting diode 218. The driving circuit includes a switching transistor 212, a current driving transistor 214 and a storage capacitor 216. The switching transistor 212 is switched by a scan signal SCAN from the scan line 202 to charge and store a data signal DATA from the data line 204 into the storage capacitor 216.

The source and drain of the current driving transistor 214 are serially coupled between a ground potential and the anode of the organic light-emitting diode 218, while the cathode of the organic light-emitting diode 218 is coupled with a negative voltage (−V). The storage capacitor 216 is coupled between the gate and the source of the current driving transistor 214. In an embodiment, the negative voltage (−V) can be about −12V, but other voltage levels may be adequate.

In operation, the application of an addressing voltage signal SCAN at the gate of the switching transistor 212 causes the storage capacitor 216 to be charged with an image data signal DATA. The charged storage capacitor 216 turns on the current driving transistor 214 that works in a saturation range to deliver an electric current I to the organic light-emitting diode 218 for image displaying.

As shown in FIG. 2B, the power source implemented to drive a pixel includes a ground potential terminal and a negative voltage terminal (−V). The power voltage generator circuit therefore is more simple and economical to manufacture, and the size of the electroluminescent display further can be advantageously reduced.

Figure 2C:
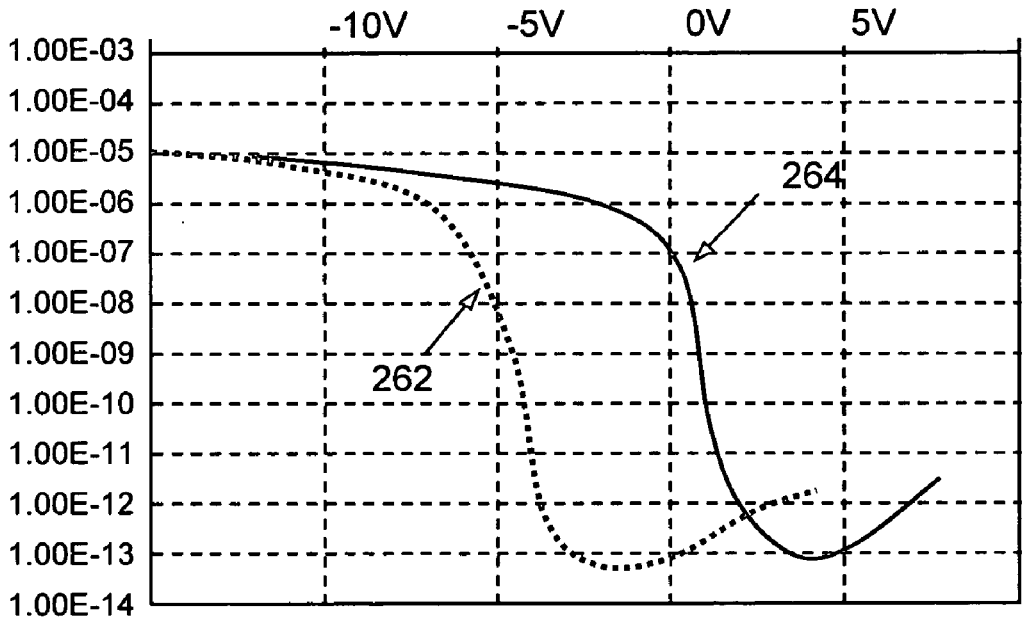
FIG. 2C is a graph plotting a characteristic curve of a driving transistor implemented in a pixel driving circuit according to an embodiment of the invention.

FIG. 2C is a graph depicting the relation between the gate-source voltage and the drain-source current of the current driving transistor 214 implemented according to an embodiment of the invention. Reference numeral 262 refers to the characteristic curve of the driver transistor implemented in a conventional driving circuit, while reference numeral 264 refers to the characteristic curve of the current driving transistor 214 implemented in an embodiment of the invention. The range of the operating gate voltage $V_g$ of the current driving transistor 214 can be between about 0V and 3V.

As described above, the electroluminescent display implemented according to the invention can reduce the power consumption as well as energy dissipation, and has an economical manufacture cost.

Realizations in accordance with the present invention have been described in the context of particular embodiments. These embodiments are meant to be illustrative and not limiting. Many variations, modifications, additions, and improvements are possible. Accordingly, plural instances may be provided for components described herein as a single instance. Additionally, structures and functionality presented as discrete components in the exemplary configurations may be implemented as a combined structure or component. These and other variations, modifications, additions, and improvements may fall within the scope of the invention as defined in the claims that follow.

What is claimed is:

1. An electroluminescent display, comprising:

at least a scan line and a data line;

a light-emitting device; and a pixel driving circuit coupled with the scan line, the data line and the light-emitting device, wherein the pixel driving circuit when turned on in response to a scan signal issued on the scan line is configured to deliver to the light-emitting device an electric current according to a data signal delivered through the data line;

wherein the pixel driving circuit is coupled between a ground potential terminal and a negative voltage terminal, and the pixel driving circuit further comprises a PMOS transistor having a gate coupled to the scan signal and the data signal, wherein the PMOS transistor receives a gate-source voltage substantially equal to 0V at an ON state and a positive gate-source voltage at an OFF state.

2. The electroluminescent display according to claim 1, wherein the pixel driving circuit and the light-emitting device are serially coupled between the ground potential terminal and the negative voltage terminal.

3. The electroluminescent display according to claim 1, wherein the pixel driving circuit comprises:

a current driving circuit that includes the PMOS transistor having a source coupled to the ground potential terminal and a drain coupled to the negative voltage terminal through the light-emitting device;

a storage capacitor coupled with the current driving circuit; and a switch circuit coupled with the scan line, the data line and the storage capacitor;

wherein the current driving circuit is configured to deliver to the light-emitting device an electric current according to a charge voltage of the storage capacitor selectively charged by the switch circuit in response to the scan and data signals received on the scan and data lines, respectively.

4. The electroluminescent display according to claim 3, wherein the PMOS transistor is in a saturation range when it is at the ON state.

5. The electroluminescent display according to claim 3, wherein the switch circuit includes a thin film transistor operating as a switch.

6. The electroluminescent display according to claim 1, wherein the light-emitting device includes an organic light-emitting diode.

7. The electroluminescent display according to claim 6, wherein the negative voltage terminal is connected to a cathode of the organic light-emitting diode.

8. An electroluminescent display, comprising:

a power voltage source having a negative voltage terminal and a ground potential terminal; and a pixel driving circuit coupled between the negative voltage terminal and the ground potential to drive the operation of a light-emitting device in response to addressing and image data signals inputted to the pixel driving circuit, wherein the pixel driving circuit further comprises a PMOS transistor having a gate coupled to the addressing signal and the image data signal, wherein the PMOS transistor receives a gate-source voltage substantially ecual to 0V at an ON state and a positive gate-source voltage at an OFF state.

9. The electroluminescent display according to claim 8, wherein the pixel driving circuit and the light-emitting device are serially coupled between the ground potential terminal and the negative voltage terminal.

10. The electroluminescent display according to claim 8, wherein the light-emitting device includes an organic light-emitting diode.

11. The electroluminescent display according to claim 10, wherein a cathode of the organic light-emitting diode is connected to the negative voltage terminal.

12. The electroluminescent display according to claim 8, wherein the pixel driving circuit comprises:

a current driving circuit that includes the PMOS transistor having a source coupled to the ground potential terminal and a drain coupled to the negative voltage terminal through the light emitting device;

a storage capacitor coupled with the current driving circuit; and a switch circuit coupled with the storage capacitor;

wherein the current driving circuit is configured to deliver to the light-emitting device an electric current according to a charge voltage of the storage capacitor charged through the switch circuit in response to the addressing and image data signals.

13. The electroluminescent display according to claim 12, wherein the PMOS transistor is in a saturation range when it is at the ON state.

14. The electroluminescent display according to claim 12, wherein the switch circuit includes a thin film transistor operating as a switch.

15. The electroluminescent display according to claim 3, wherein the PMOS transistor has a saturation voltage substantially equal to 0V.

16. The electroluminescent display according to claim 12, wherein the PMOS transistor has a saturation voltage substantially equal to 0V.

* * * * *